US009115951B2

(12) United States Patent
Bentley

(10) Patent No.: US 9,115,951 B2
(45) Date of Patent: Aug. 25, 2015

(54) RAPID DISASSEMBLING SHOTGUN

(71) Applicant: ADAPTIVE TACTICAL LLC, Nampa, ID (US)

(72) Inventor: James K. Bentley, Eagle, ID (US)

(73) Assignee: ADAPTIVE TACTICAL LLC, Nampa, ID (US)

( * ) Notice: Subject to any disclaimer, the term of this patent is extended or adjusted under 35 U.S.C. 154(b) by 0 days.

(21) Appl. No.: 14/592,666

(22) Filed: Jan. 8, 2015

(65) Prior Publication Data

US 2015/0198403 A1 Jul. 16, 2015

Related U.S. Application Data

(60) Provisional application No. 61/926,126, filed on Jan. 10, 2014, provisional application No. 62/036,494, filed on Aug. 12, 2014.

(51) Int. Cl.

| | |
|---|---|
| ***F41A 9/72*** | (2006.01) |
| ***F41C 7/02*** | (2006.01) |
| ***F41A 21/48*** | (2006.01) |
| ***F41C 7/00*** | (2006.01) |

(52) U.S. Cl.

CPC ..... *F41A 21/484* (2013.01); *F41C 7/00* (2013.01)

(58) Field of Classification Search

CPC ..... F41A 9/72; F41A 21/48; F41A 21/484; F41C 7/02; F41C 9/00; F41C 9/02; F41C 9/04; F41C 23/16; F41C 27/18; F41C 7/00

USPC ..... 42/75.01, 75.02, 75.03, 75.1, 85, 86

See application file for complete search history.

(56) References Cited

U.S. PATENT DOCUMENTS

| | | | | | |
|---|---|---|---|---|---|
| 798,540 | A | * | 8/1905 | Stevenson et al. | 42/17 |
| 951,657 | A | * | 3/1910 | Pedersen | 42/49.01 |
| 993,817 | A | * | 5/1911 | Bennet | 42/49.01 |
| 2,596,841 | A | * | 5/1952 | Davidson | 42/17 |
| 3,018,577 | A | * | 1/1962 | La Violette, Jr. | 42/6 |
| 3,412,497 | A | * | 11/1968 | Denton et al. | 42/54 |
| 3,883,976 | A | * | 5/1975 | Norman et al. | 42/49.01 |
| 4,649,800 | A | * | 3/1987 | Tessier | 89/194 |
| 5,771,620 | A | * | 6/1998 | Crawford et al. | 42/19 |
| 6,032,395 | A | * | 3/2000 | Bentley et al. | 42/19 |
| 8,485,173 | B1 | * | 7/2013 | Tseng | 124/73 |
| 2010/0071541 | A1 | * | 3/2010 | Barrett | 89/191.01 |
| 2012/0325079 | A1 | * | 12/2012 | Plebani et al. | 89/193 |

* cited by examiner

*Primary Examiner* — Bret Hayes
(74) *Attorney, Agent, or Firm* — Parsons Behle & Latimer

(57) ABSTRACT

A mechanism for selectively connecting a magazine tube to a receiver of a magazine fed shotgun. The mechanism permits the rapid attachment to or detachment from of the magazine tube to the receiver of the shotgun. The mechanism may be a connector threaded into the end of the magazine tube. A locking profile may be connected to the end of the connector and may provide an access path. A pin may be passed through the access path and the magazine tube may then be rotated to position the pin into the locking profile. The rotation may be less than one half of a rotation. A plug may be threaded into the receiver. The pin may be connected to the plug. A spring may be used to bias the magazine tube in a locked position. A protrusion and nut may prevent movement between the magazine tube and receiver.

18 Claims, 17 Drawing Sheets

RAPID DISASSEMBLING SHOTGUN

RELATED APPLICATION DATA

The present application claims the benefit of priority under 35 U.S.C. §119 to U.S. Provisional Application No. 61/926,126, filed Jan. 10, 2014, entitled "Rapid Disassembling Shotgun," and U.S. Provisional Application No. 62/036,494, filed Aug. 12, 2014, entitled "Rapid Disassembling Shotgun," the disclosures of which are incorporated herein by reference in their entireties.

BACKGROUND

1. Field of the Disclosure

The embodiments described herein relate to a shotgun that may be rapidly disassembled into component parts for transportation and/or storage purposes. The shotgun may be a magazine fed shotgun that does not use a magazine tube for the storage and feeding of shotgun shells into the receiver.

2. Description of the Related Art

Shotguns are typically comprised of a number of components connected together to form the firearm. A shotgun often includes a barrel and a magazine tube connected to a receiver. A stock may be connected to the other end of the receiver. The barrel and magazine tube may both be removed from the receiver permitting the storage of the components in a disassembled state. However, it takes some time to disassemble the magazine tube and barrel from the receiver. For example, the magazine tube may need to be rotated multiple times to unthread the end of the magazine tube from the receiver. The time required to disassemble the shotgun may not be desirable. It may be beneficial to provide a magazine tube that may be quickly released from the receiver. For example, it may be beneficial to provide a shotgun that may release the magazine tube from the receiver with less than one rotation of the magazine tube.

SUMMARY

The present disclosure is directed to a rapid disassembling shotgun that overcomes some of the problems and disadvantages discussed above.

One embodiment is a shotgun system comprising a plug, magazine tube, and connector. The plug is configured to connect to a receiver. The plug includes a central opening and a pin positioned across the central opening. The connector includes an access path and a locking profile on a first end of the connector. A portion of a second end of the connector is positioned within an end of the magazine tube. The magazine is connected to the plug by inserting the connector into the central opening of the plug to move the pin along the access path. The magazine tube is rotated to position the pin in the locking profile of the connector.

By way of example, the shotgun system may include a receiver with a barrel opening and a magazine tube opening. At least a portion of the plug may be positioned within the magazine tube opening. The plug may have a protrusion on a first face. The protrusion may be biased in an outward position and retracts within the first face when force is applied against the protrusion. The protrusion may be a ball bearing. The plug may include a hollow column containing the ball bearing. The column may have a first end at the first face and a second end at a second face. The first end of the column may have a smaller diameter than a diameter of the second of the column and the diameter of the first end may be smaller than a diameter of the ball bearing. A ball detent spring may bias the ball bearing against the first end of the column such that a portion of the ball bearing protrudes beyond the first face.

The connector may include a spring contained within the connector. The spring may be configured to bias the pin of the plug within the locking profile of the connector. The first end of the connector may have a smaller outer diameter than an outer diameter of the second end. The shotgun system may include a nut threaded upon a threaded portion of the first end of the connector. The nut may have a detent on a first face configured to engage the protrusion on the first face of the plug.

The shotgun system may include a ramp connected to the receiver. The ramp may feed shells into a firing chamber of the receiver. A spring may be positioned between the ramp and the plug. The spring may be configured to bias the pin of the plug within the locking profile of the connector. The ramp may include a recess configured to engage a lug on a magazine inserted into the receiver.

One embodiment is a method for rapid assembly and disassembly of a shotgun comprising providing a pin within a portion of a shotgun receiver and providing a locking profile connected to a first end of a magazine tube. The first end of the magazine tube is configured to be inserted into the portion of the shotgun receiver such that the pin passes into an access path connected to the locking profile. The locking profile is configured such that rotation of the magazine tube within the shotgun receiver positions the pin into the locking profile.

The rotation of the magazine tube may be less than one half of a rotation. The pin may be attached to a plug positioned within the receiver and the locking profile may be on a first end of a connector. A portion of a second end of the connector may be positioned within the first end of the magazine tube.

The method may include providing an external thread attached to the first end of the magazine tube and providing a nut having an internal thread. The nut may be configured to thread upon the external thread. The method may include providing a detent on a face of the nut and providing a protrusion connected to a portion of the shotgun receiver. The protrusion may be configured to engage the detent when the nut is rotated along the external thread. The method may include providing a spring configured to bias the magazine tube to selectively retain the pin in the locking profile. The locking profile may be configured such that pushing against the magazine tube when the pin is in the locking profile overcomes the biasing and rotating the magazine tube positions the pin within the access path.

One embodiment is a shotgun system comprising a plug, a connector, and a magazine tube. The plug includes a pin. The connector includes a locking profile. The magazine tube is connected to one of the plug and the connector. The insertion and rotation of the connector into the plug moves the pin into the locking profile of the connector to selectively connect the connector to the plug. The shotgun system may include a receiver having a barrel opening and a magazine tube opening. The magazine tube opening may be connected to one of the plug and the connector.

One embodiment is a shotgun system comprising a receiver, a magazine tube, a connector, and a pin. The receiver includes a barrel opening and a magazine tube opening. The connector includes a locking profile. The insertion and rotation of the magazine tube into the receiver moves the pin into the locking profile of the connector to selectively connect the magazine tube to the receiver.

Figure 1:
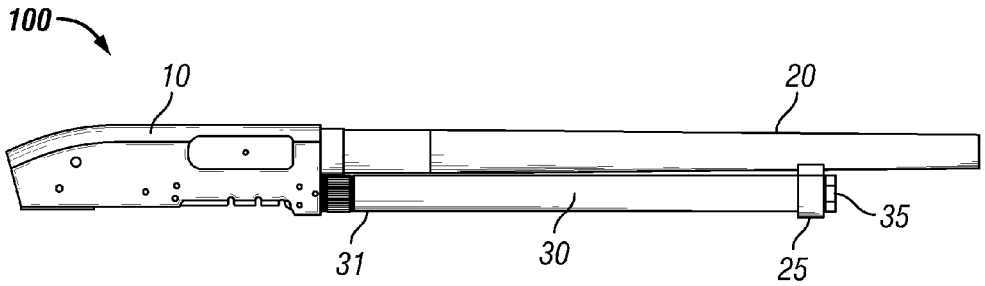
FIG. 1 shows an embodiment of a shotgun.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows a magazine fed shotgun 100 with a quick release mechanism for a magazine tube of a shotgun. The magazine fed shotgun 100 is comprised of a receiver 10, a barrel 20 connected to the receiver 10, and a magazine tube 30 that quickly connects to and disconnects from the receiver 10. One end of the barrel 20 is inserted into the receiver 10 and the other end of the barrel 20 includes a lug 25 through which the magazine tube 30 is inserted. One end 31 of the magazine tube 30 is inserted into the receiver 10. The other end 35 of the magazine tube 30 is threaded and protrudes through the lug 25 of the barrel 20. A nut (not shown) may be threaded onto the end 35 of the magazine tube 30 to retain the magazine tube 30 within the receiver 10 and lug 25 as is previously known. In some embodiments, the end 35 of the magazine tube 30 may have an internal thread and may not extend past the lug 25 of the barrel 20. A magazine end plug (not shown) may extend through the lug 25 and into the internal thread on the end 35 of the magazine tube 30, such that the nut secures the end 35 of the magazine tube 30 within the lug 25 and the nut abuts against the lug 25. The shotgun 100 is a magazine fed shotgun that feeds shells from a magazine (not shown) positioned beneath the receiver 10 and does not use the magazine tube 30 for the storage and/or feeding of shells into the receiver 10. By way of example, the shotgun may be used with a modular shotgun magazine as described in U.S. patent application Ser. No. 14/259,525, filed on Apr. 23, 2014, and entitled "Modular Shotgun Box Magazine," the disclosure of which is hereby incorporated by reference in its entirety.

Figure 2:
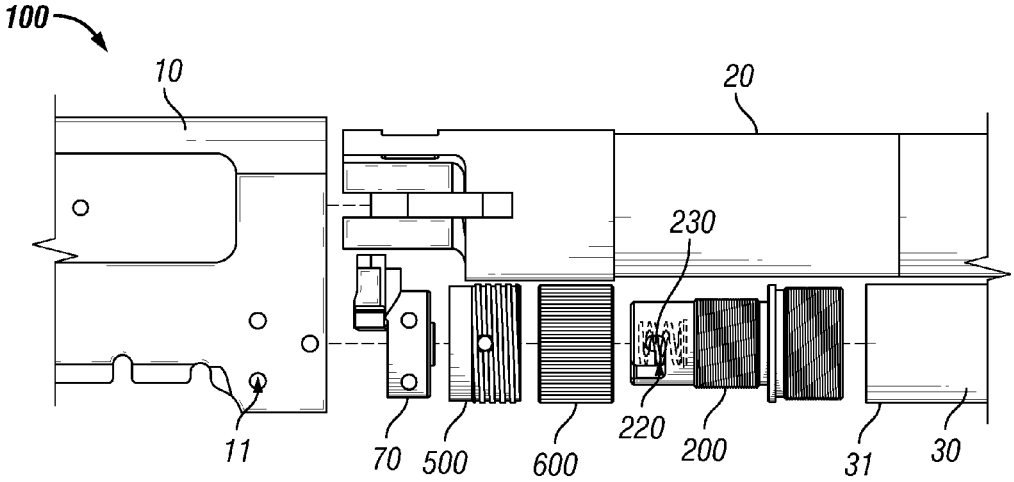
FIG. 2 shows an exploded close-up view of a portion of an embodiment of a shotgun.

FIG. 2 shows an exploded view of the shotgun 100 of FIG. 1. The shotgun contains a quick release mechanism to enable the shotgun 100 to be assembled and dissembled more quickly than known shotguns having magazine tubes. A connector 200 is connected to an end 31 of the magazine tube 30. In one embodiment, the connector 200 is threaded into the end 31 of the magazine tube 30. The connector 200 does not permit the use of the magazine tube 30 for the storage and/or feeding of shells into the receiver 10 as would be appreciated by one of ordinary skill in the art having the benefit of this disclosure. The connector 200 includes a locking profile 220 at the end of the connector 200. The locking profile 220 may be integral to the connector 200 or the locking profile 220 may be connected to the end of the connector 200. A plug 500 is connected to the receiver 10. The plug 500 may be threaded into receiver 10. The positions of the plug 500 and connector 200 may be interchangeable as would be appreciated by one of ordinary skill in the art having the benefit of this disclosure.

A pin 510 (shown in FIG. 7) is connected to the plug 500. The pin 510 of the plug 500 is passed through an access path 280 (shown in FIG. 11) to engage the locking profile 220 and selectively connect the magazine tube 30 to the receiver 10 through their connections to the plug 500 and connector 200. A nut 600 may be threaded onto an exterior portion of the connector 200 to prevent movement between the components due to manufacturing tolerances. The shotgun 100 may include a feed ramp 70 used for feeding shells from the magazine (not shown) into the firing chamber of the receiver 10. The ramp 70 may also guide the shell sweep into a pocket in the receiver 10 as would be appreciated by one of ordinary skill having the benefit of this disclosure. A spring 230 may be positioned within the connector 200, and may apply force against the pin 510 to bias the pin 510 within the locking profile 220.

Figure 3:
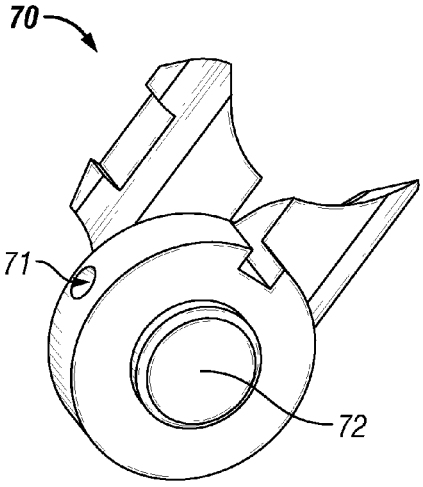
FIG. 3 shows a front perspective view of an embodiment of a ramp.
Figure 4:
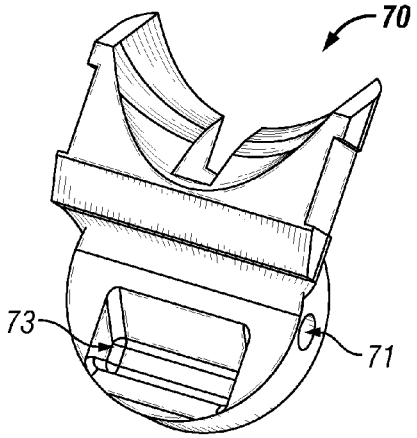
FIG. 4 shows a rear perspective view of an embodiment of a ramp.

FIG. 3 shows a perspective view of an embodiment of a feed ramp 70 that may be used to feed shells into the receiver 10 from a magazine. The front side of the ramp 70 includes a protrusion 72 onto which a spring may be positioned. In one embodiment, the spring may apply force to the connector 200 to bias a pin 510 within the locking profile 220 to selectively retain the magazine tube 30 within the receiver 10. The ramp 70 may include aperture 71 that permits the connection of the ramp 70 to the receiver 10. FIG. 4 shows a rear perspective view of an embodiment of the feed ramp 70. The receiver 10 may include aperture 11 (shown in FIG. 2) to secure ramp 70 within the receiver 10. By way of example, aperture 71 on the ramp 70 may be aligned with aperture 11 of the receiver 10 for receiving a pin or a fastener. The receiver may include multiple apertures and the ramp may include multiple apertures. The ramp 70 may also include a recess 73 that may be used to selectively retain a lug from a magazine inserted into the receiver 10 as would be appreciated by one of ordinary skill in the art having the benefit of this disclosure.

Figure 5:
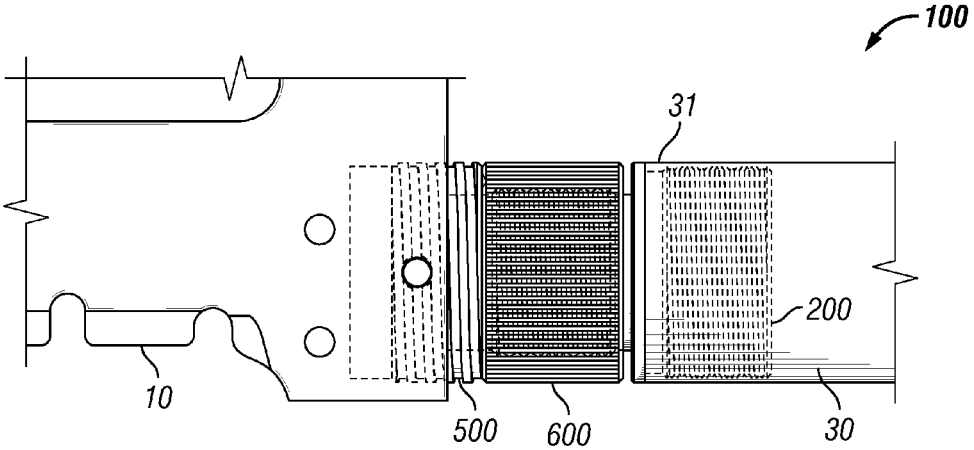
FIG. 5 shows a close-up view of an embodiment of a quick release mechanism for a magazine tube of a shotgun.
Figure 6:
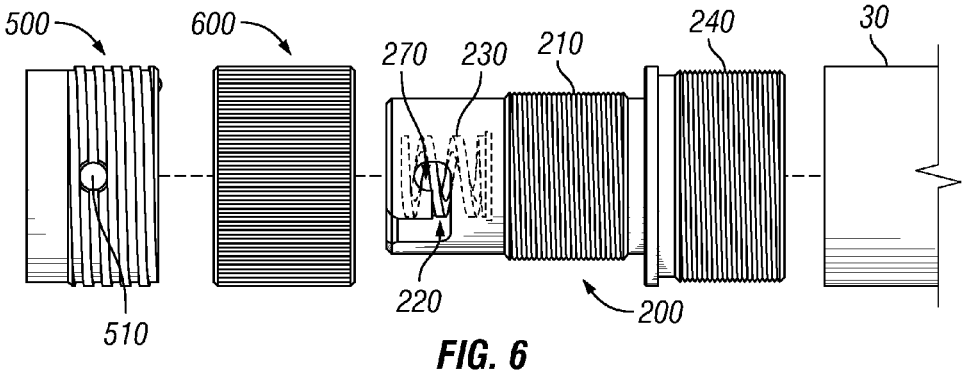
FIG. 6 shows an exploded side view of an embodiment of a quick release mechanism for a magazine tube of a shotgun.

FIG. 5 shows a partial close up view of an embodiment of a quick release mechanism for a magazine tube of a shotgun. A plug 500 may be threaded into a portion of the receiver 10 and a connector 200 may be threaded into the end 31 of the magazine tube 30 via external threads 240 (shown in FIG. 6). A nut 600 may be threaded onto an external thread 210 on a portion of the connector 200 before insertion of the connector 200 into the plug 500. FIG. 6 shows an exploded view of an embodiment of the quick release mechanism for a magazine tube of a shotgun. As the magazine tube 30 with the connector 200 are inserted into the receiver 10 and plug 500, the pin 510 passes along an access path 280 (shown in FIG. 11) and into the locking profile 220 until the pin 510 is positioned within a recess 270 in the locking profile 220. The magazine tube 30 and thus, the locking profile 220 and connector 200 may be rotated to align the pin 510 with the locking profile 220 within the interior of the connector 200. The pin 510 engages recess 270 of the locking profile 220 on the connector 200 to selectively secure the magazine tube 30 to the receiver 10. A spring 230 within the connector 200 biases the pin 510 into the recess 270 in the locking profile 220 to selectively retain the pin 510 within the locking profile 220. Once the connector 200 has been inserted into the plug 500, the nut 600 may be rotated along threads 210 to abut against the plug 500 to prevent movement between the components due to manufacturing tolerances.

Figure 7:
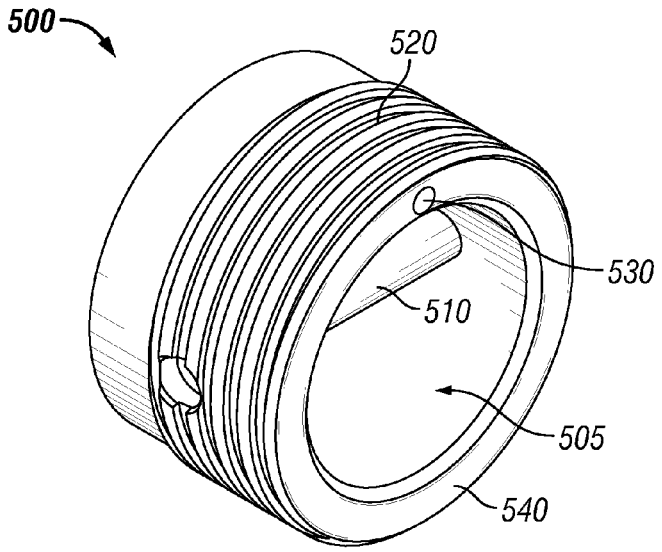
FIG. 7 shows a perspective view of an embodiment of a plug.

FIG. 7 shows an embodiment of a plug 500 having a pin 510 and a central opening 505. The pin 510 engages the locking profile 220 of the connector 200 to selectively connect the magazine tube 30 to the receiver 10. The central opening 505 allows a connector 200 to be inserted into the plug 500 such that the pin 510 may engage the locking profile 220. The pin 510 may be positioned across the central opening 505. A protrusion 530 on a first face 540 of the plug 500 may engage with a detent 610 of the nut 600 (shown in FIG. 9) when assembly is complete. The plug 500 may have exterior threads 520 which enable the plug 500 to be threaded into the receiver 10. The pin 510 may traverse the width of the plug 500. In another embodiment, the plug may be cup-shaped, with one end of the plug being enclosed. The plug may include a spring positioned between the enclosed end and a pin to bias the magazine tube 30 in a locked position.

Figure 8:
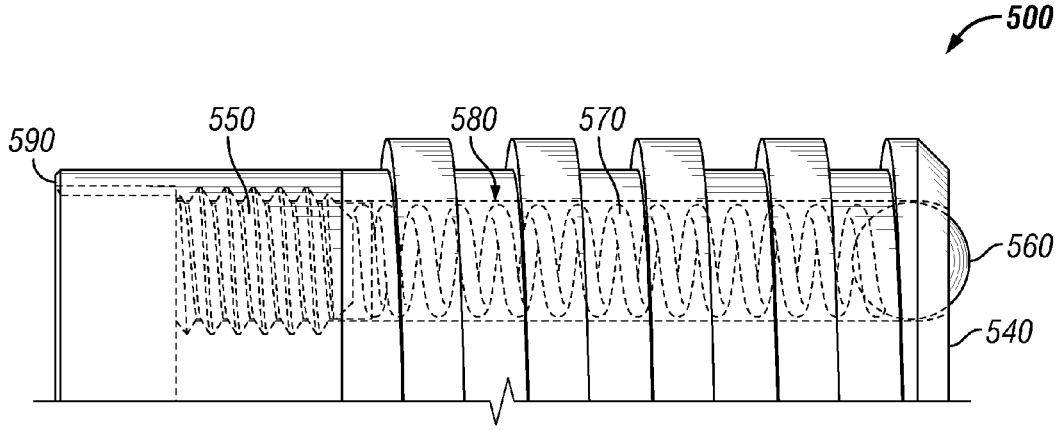
FIG. 8 shows a partial close-up view of an embodiment of a plug having a hollow column and ball bearing.

By way of example, the protrusion 530 may be a ball bearing 560. FIG. 8 shows a close-up partial side view of an embodiment of a plug 500 with a set screw 550, ball bearing 560, and a ball detent spring 570. In one embodiment, a hollow column 580 traverses the depth of the plug 500, with the diameter at the first face 540 of the plug 500 being smaller than the diameter at a second face 590. The end of the hollow column 580 at the second face 590 may be threaded to engage a set screw 550. A ball bearing 560, with a diameter greater than the column diameter at the first face 540 of the plug 500, may be placed within the hollow column 580 such that a portion of the ball bearing 560 protrudes beyond the first face 540 of the plug 500. In such an embodiment, the portion of the ball bearing 560 protruding beyond the first face 540 of the plug 500 creates the protrusion 530 on the first face 540 as shown in FIG. 7. A ball detent spring 570 may bias the ball bearing 560 in the column opening at the first face 540. A set screw 550 may be threaded into the end of the hollow column 580 to secure the ball detent spring 570 and ball bearing 560 within the hollow column 580.

Figure 9:
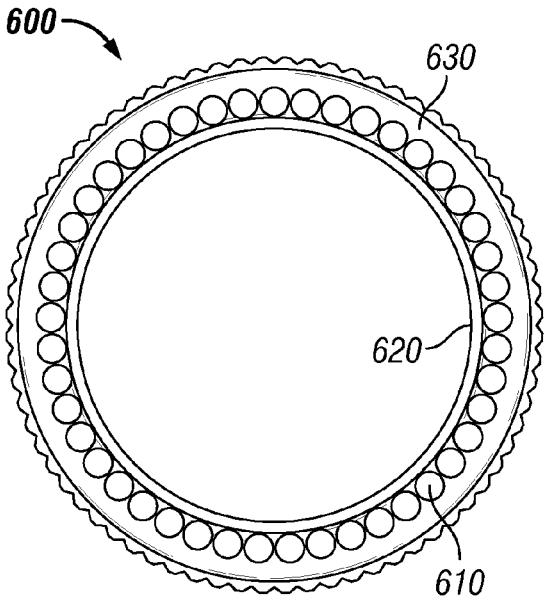
FIG. 9 shows a front view of an embodiment of a nut.

FIG. 9 shows an embodiment of a nut 600. The nut 600 has internal threads 620 which enable the nut to engage the external threads 210 on the connector 200. The nut 600 also includes at least one detent 610 on one face 630 of the nut 600 for engaging the protrusion 530 on the first face 540 of the plug 500. By way of example, the nut 600 may have multiple detents 610 as shown in FIG. 9.

Figure 10:
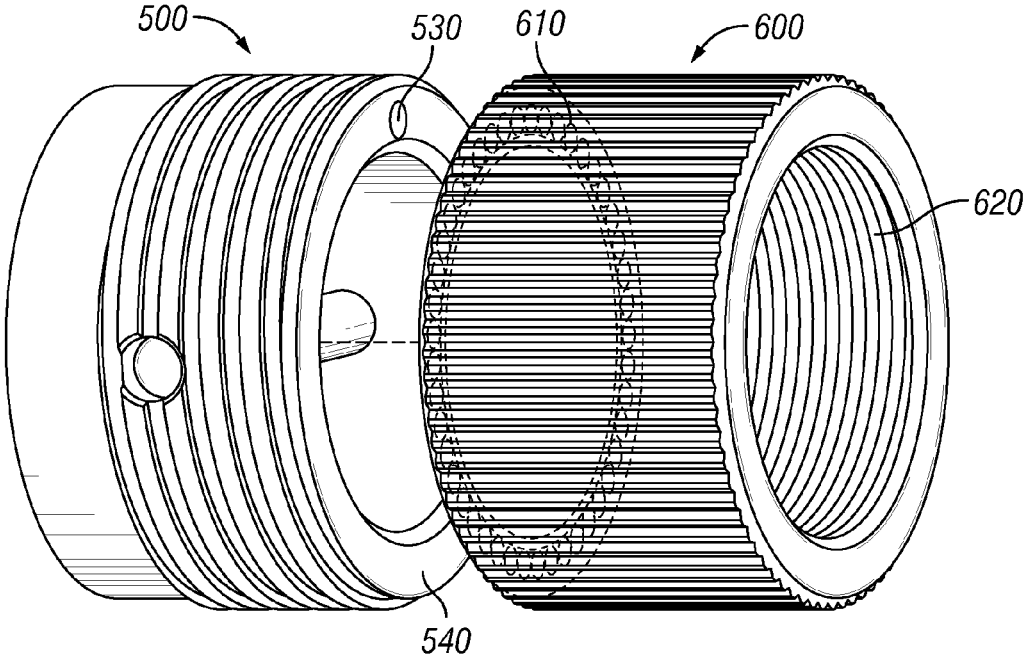
FIG. 10 shows a perspective view of a plug and nut before the nut is engaged with the plug.

FIG. 10 shows a perspective view of a plug 500 and nut 600 before the nut 600 is engaged with the plug 500. The connector 200 has been removed to illustrate the interface between the shown components. After the connector 200 is inserted into the plug 500, the nut 600 is rotated along the threads 210 on an exterior portion of the connector 200 to abut against the face 540 of plug 500 to ensure a tight connection between the magazine tube 30 and the receiver 10. The detent 610 of the nut 600 engages the protrusion 530 on the plug 500. The adjustability of the nut 600 is advantageous because the initial position of the nut 600 provides clearance for the connector 200 to be more easily inserted into the plug 500 and, once rotated, the nut 600 may prevent movement between the connecting components due to manufacturing tolerances.

Figure 11:
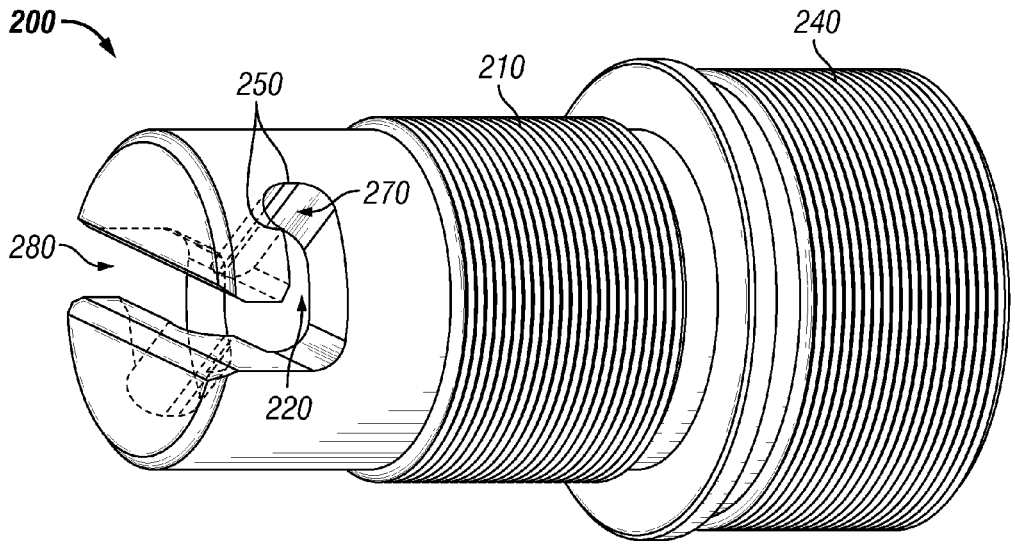
FIG. 11 shows a perspective view of an embodiment of a connector.

FIG. 11 shows an embodiment of a connector 200. The connector 200 has a first end and a second end. Connector 200 includes exterior threads 240 on the second end that permit the connector 200 to be threaded into the end 31 of the magazine tube 30. The first end may have a smaller outer diameter than an outer diameter of the second end. The connector 200 also includes a set of threads 210, located on the first end, for the retention of the nut 600 on the connector 200. The set of threads 210 may have greater length than the corresponding threads 620 on the nut 600 such that the nut 600 may be rotated along the threads 210 to abut against the outside of plug 500 as discussed herein. When the detent 610 of the nut 600 engages the protrusion 530 of the plug 500, all threads 620 on the nut 600 may still be engaged with the threads 210 on the connector 200.

The connector 200 may include a locking profile 220 for selectively securing the connector 200 to the plug 500. The locking profile 220 includes an access path 280 that permits the passage of a pin 510 of the plug 500 into the locking profile 220. The locking profile 220 includes a recess 270 and permits the rotation of the pin 510 within the interior of the connector 200 via the access path 280. The pin 510 is selectively retained in recess 270 when engaged with the locking profile 220. Shoulders 250 of the locking profile 220 may selectively prevent the rotation of the pin 510 past the locking profile 220 or in the wrong direction when attempting to remove the magazine tube 30 from the receiver 10. The shoulders 250 may also selectively prevent the force of the spring 230 from driving the pin 510 out of the locking profile 220. The shape and configuration of the locking profile 220 is for illustrative purposes only. Various configurations may be used to permit the passage of a pin 510 and subsequent rotation of the magazine tube 30 to move the pin 510 into a selectively locked engagement with the locking profile 220 as would be appreciated by one of ordinary skill in the art having the benefit of this disclosure.

Figure 12:
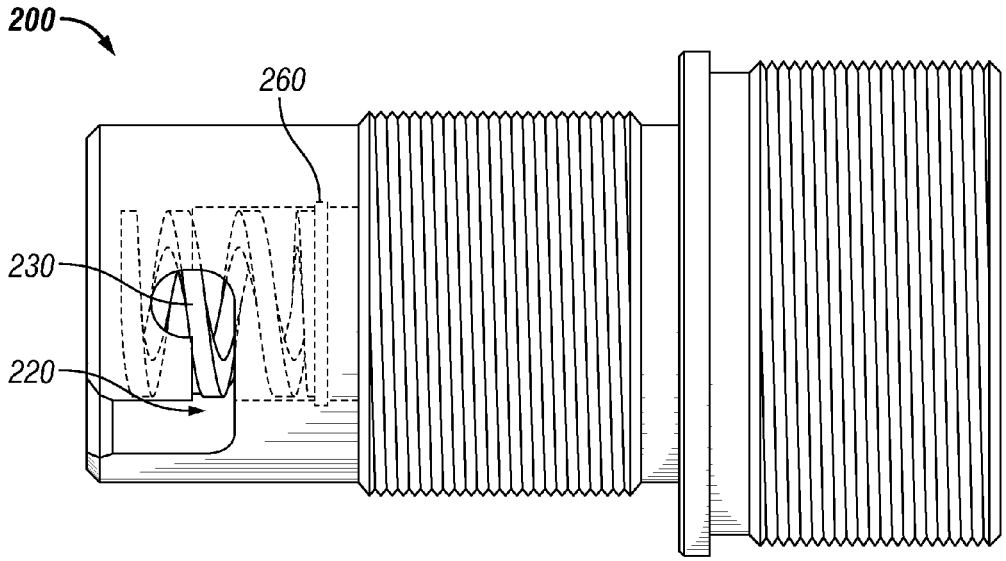
FIG. 12 shows a side view of an embodiment of a connector with an internal spring and retaining clip.

FIG. 12 shows that a spring 230 and retaining clip 260 may be contained within the connector 200. The spring 230 applies force against the locking pin 510 to bias the pin 510 within the recess 270 of the locking profile 220 to selectively retain the pin 510 and thus, selectively connect the magazine tube 30 to the receiver 10. The magazine tube 10 may be removed from the receiver 10 by pushing against the bias of spring 230 and rotating the pin 510 out of the recess 270 of the locking profile 220 and aligning the pin 510 with the access path 280 so that the pin 510 may be passed out of the connector 200. The retaining clip 260 retains the spring 230 within a portion of the connector 200 and prevents the spring 230 from dislodging from the connector 200 when the spring 230 is compressed against the pin 510.

Figure 13:
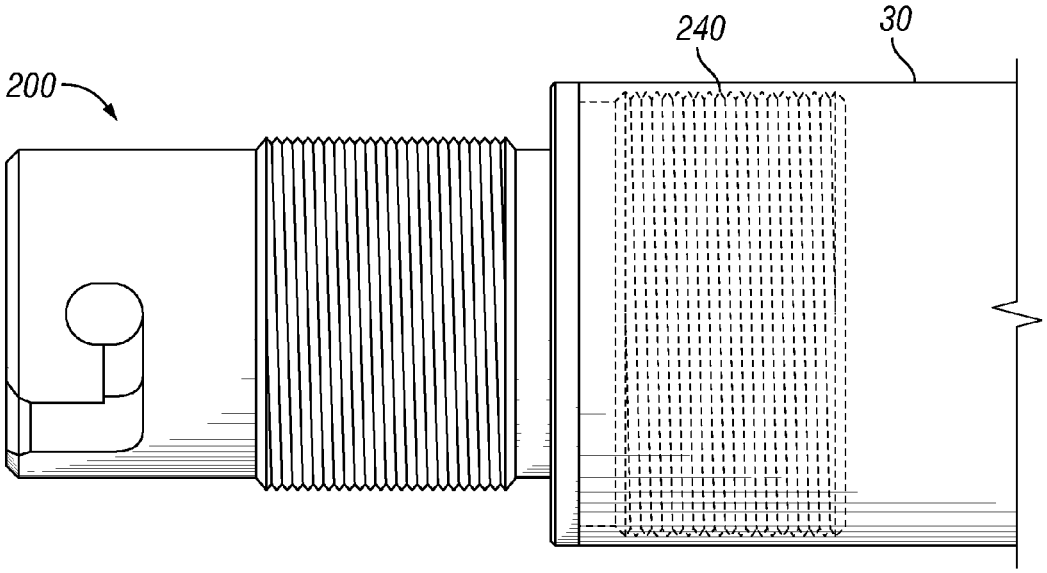
FIG. 13 shows a side view of the connector secured within the magazine tube.

FIG. 13 shows a side view of the engagement between the connector 200 and magazine tube 30. The external threads 240 of the connector 200 enable the connector 200 to be threaded into the magazine tube 30 to securely hold the connector 200 within the magazine tube 30.

Figure 14:
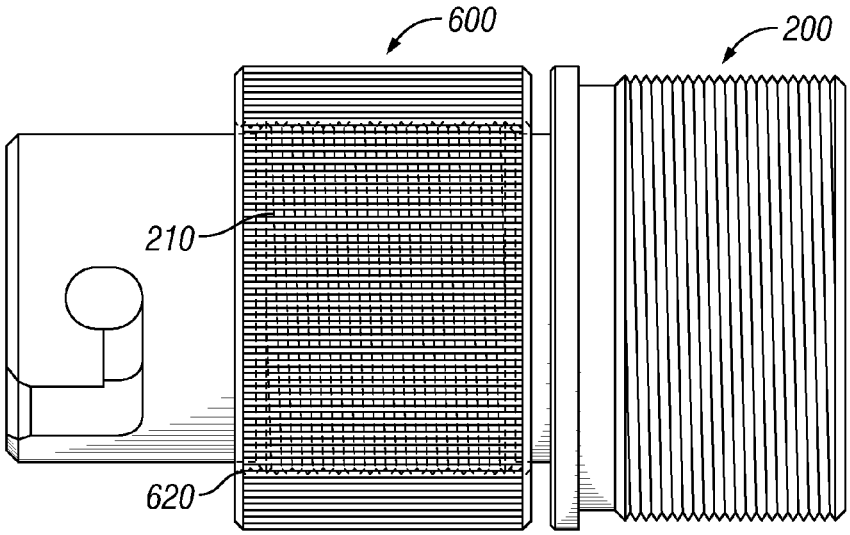
FIG. 14 shows a side view of the nut threaded upon the connector.
Figure 15:
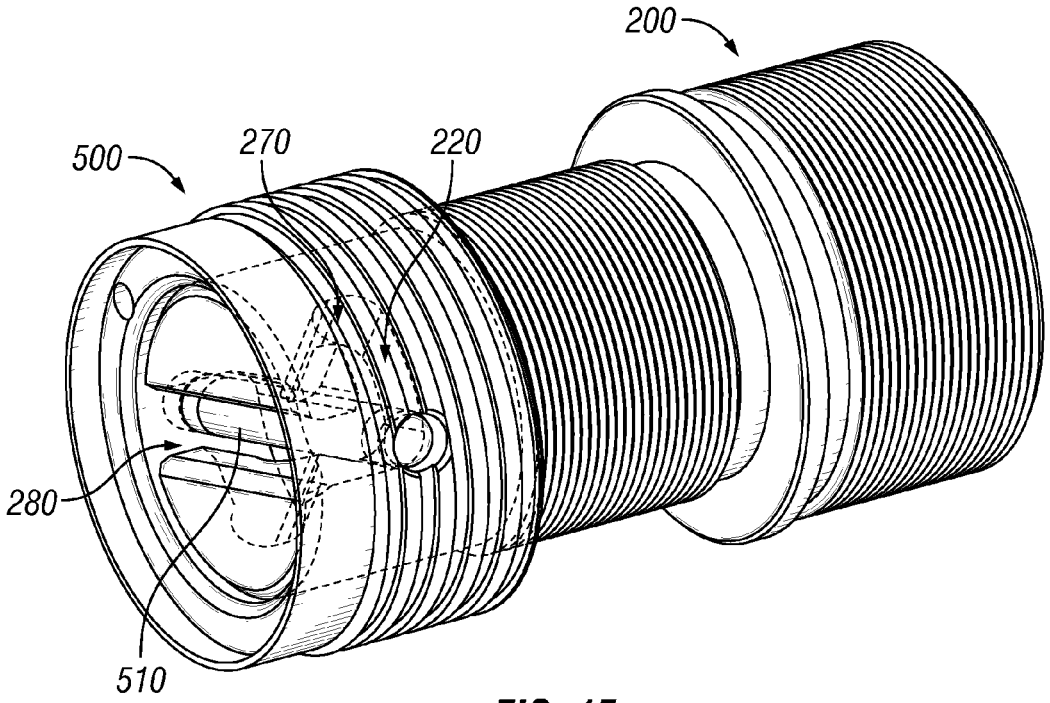
FIG. 15 shows a perspective view of the pin of the plug within the access path of the connector.

FIG. 14 shows a side view of the engagement between the connector 200 and nut 600. The nut 600 may be threaded onto the external threads 210 of the connector 200. The connector 200 may be inserted into the central opening 505 of the plug 500 such that the pin 510 moves along the access path 280 as shown in FIG. 15. The nut 600 has been removed in FIGS. 15 and 16 to illustrate the interface between the shown components.

Figure 16:
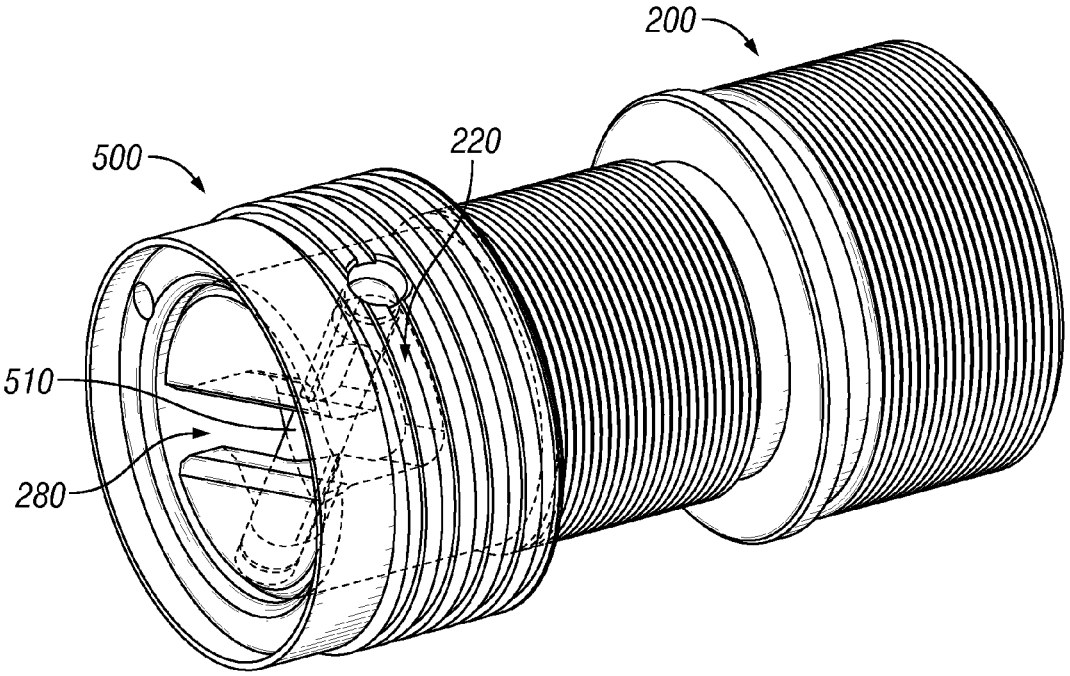
FIG. 16 shows a perspective view of the pin of the plug secured within the locking profile of the connector.

Once the connector 200 has been inserted into the plug 500, additional pressure may be needed to overcome the spring force generated by spring 230. The magazine tube 30 is then rotated to engage the pin 510 within the recess 270 of the locking profile 220. In one embodiment, the magazine tube need only be rotated less than a quarter of a rotation to engage the recess 270 of the locking profile 220. As shown in FIG. 16, once the connector 200 and magazine tube 30 have been rotated, the pin 510 of the plug 500 engages a recess 270 of the locking profile 220. The spring 230 within the connector 200 applies force against the pin 510 and biases the pin 510 within the locking profile 220 to selectively hold the assembly securely in place. As discussed above, in another embodiment, a spring 230 may be located between a feed ramp 70 and the plug 500 such that the spring 230 is compressed against the feed ramp 70 (shown in FIG. 3). Once the connector 200 is inserted into the plug 500 and rotated, the nut 600 may be rotated along the threads 210 so that the detent 610 on the face 630 of the nut 600 engages the protrusion 530 on the face 540 of the plug 500.

To remove the magazine tube 30 from the receiver 10, a force may be applied to the magazine tube 30 to overcome the force applied from the spring 230 and the pin 510 may be rotated until it is aligned with the access path 280 of the locking profile 220 as shown in FIG. 15. The magazine tube 30 may then be pulled out of the receiver 10 with the pin 510 moving along the access path 280 of the locking profile 220.

Figure 17:
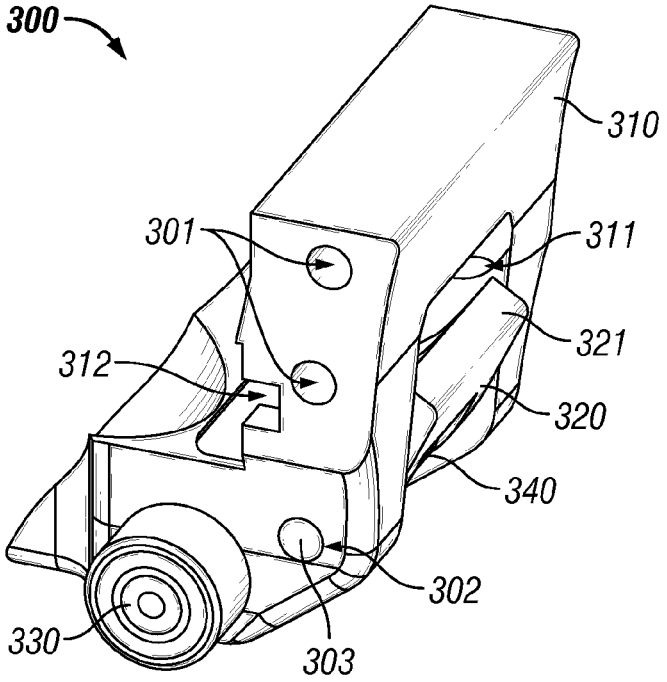
FIG. 17 is a perspective view of an embodiment of a magazine release system.
Figure 18:
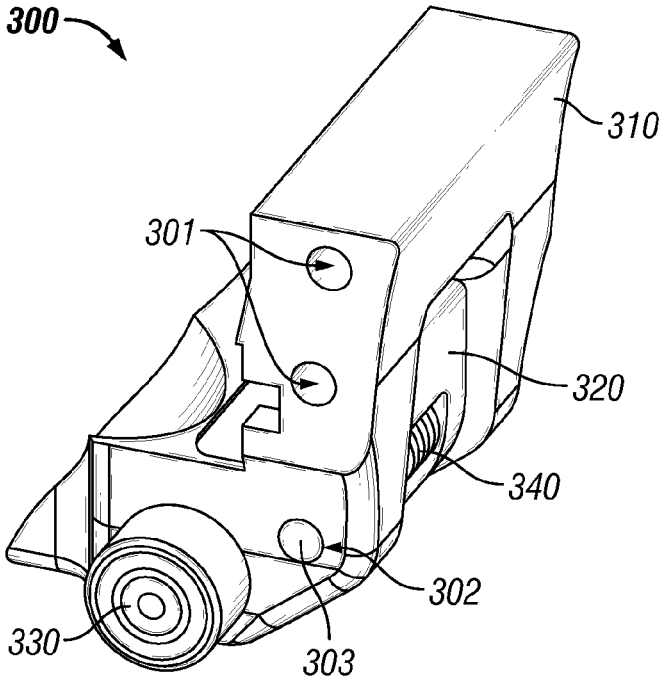
FIG. 18 is another view of the magazine release system of FIG. 17 with the magazine latch in the release position.

FIG. 17 shows an embodiment of a magazine release system 300 that may be may be attached to a receiver 10 of a shotgun 100 that holds a trigger group 400 (shown in FIGS. 21-24) in place. The trigger group 400 limits the travel of a magazine latch 320 as described in detail herein. The magazine release system 300 includes a housing 310 that houses a magazine latch 320, magazine release button 330, and spring 340. An upper portion 321 of the magazine latch 320 engages a profile on a magazine loaded into the receiver 10 to selectively retain the magazine in place. A lower portion 322 of the magazine latch 320 engages a portion of the button 330. FIG. 17 shows the magazine latch 320 in the retaining position. The housing 310 may be connected to the receiver 10 of a shotgun 100 by various means. For example, pins may be inserted though the receiver 10 and into apertures 301 to retain the housing 310 within the receiver 10. The backside of the housing 310 includes various structures such as notch 312 that retains a trigger group 400 in place. A dowel pin 303 is inserted through aperture 302 in the housing 310 that permits the latch 320 to pivot about the dowel pin 303. The magazine latch 320 is positioned within a window 311 in the housing 310 that permits the pivoting of the latch 320 about the dowel pin 303 from a retaining position shown in FIG. 17 to a retracted position shown in FIG. 18. Spring 340 is used to bias the magazine latch 320 in the retaining position in which the upper portion 321 of the magazine latch 320 extends outward from the housing 310.

Figure 19:
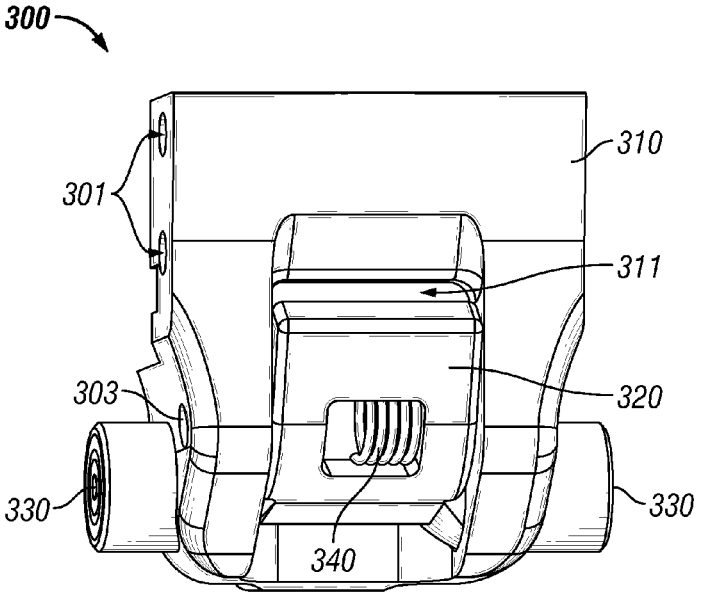
FIG. 19 is another view of the magazine release system of FIG. 17.
Figure 20:
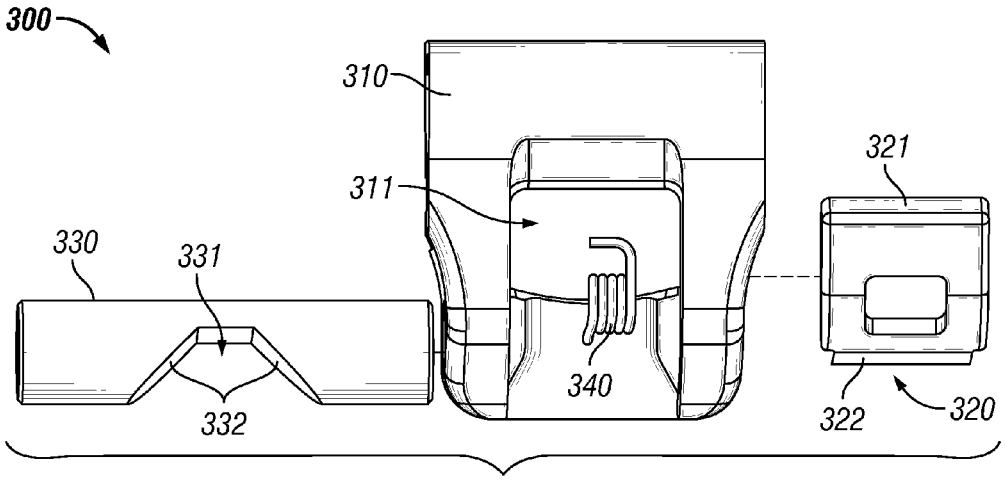
FIG. 20 shows the components of the magazine release system of FIG. 17.

FIG. 19 shows a front view of the magazine release system 300. The magazine latch 320 is positioned within a notch 331 (best shown in FIG. 20) of the magazine button 300. FIG. 20 shows an exploded view of the components of the magazine release system 300. The magazine button 330 is positioned within the housing 310 so that initially the notch 331 is centered within the window 311 of the housing 310 with the latch 320 positioned within the notch 331. The magazine button 330 includes tapered surfaces 332 on either side of the notch 331. When the magazine button 330 is pushed, on either side, the tapered surface 332 pushes the bottom portion 322 of the magazine latch 320 away from the housing 310 causing the latch 320 to pivot about the dowel pin 303 positioned within aperture 302 and causing the top portion 321 of the magazine latch 320 to move towards the housing 310. This inward movement of the upward portion 321 of the latch 320 selectively releases a magazine inserted into the receiver 10 of the shotgun 100. Spring 340 biases the upper portion 321 of the latch 320 outward from the housing 310. As a magazine is inserted into the receiver 10 the magazine pushes the upper portion 321 of the latch 320 towards the housing 310 until the magazine is fully seated and the spring 340 can bias the upper portion 321 of the magazine latch 320 to engage a profile on the magazine.

Figure 21:
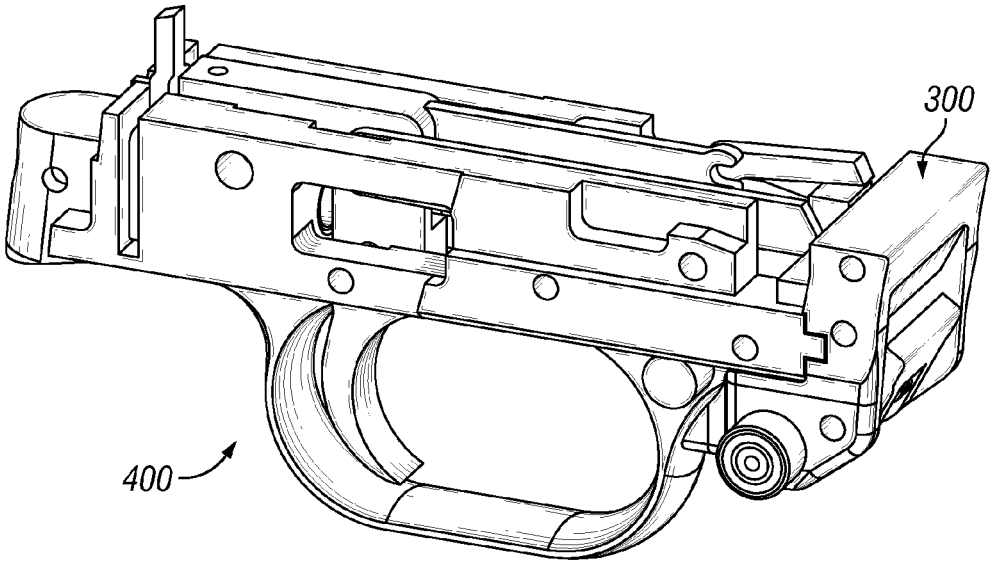
FIG. 21 shows a magazine release system retaining a trigger group.
Figure 22:
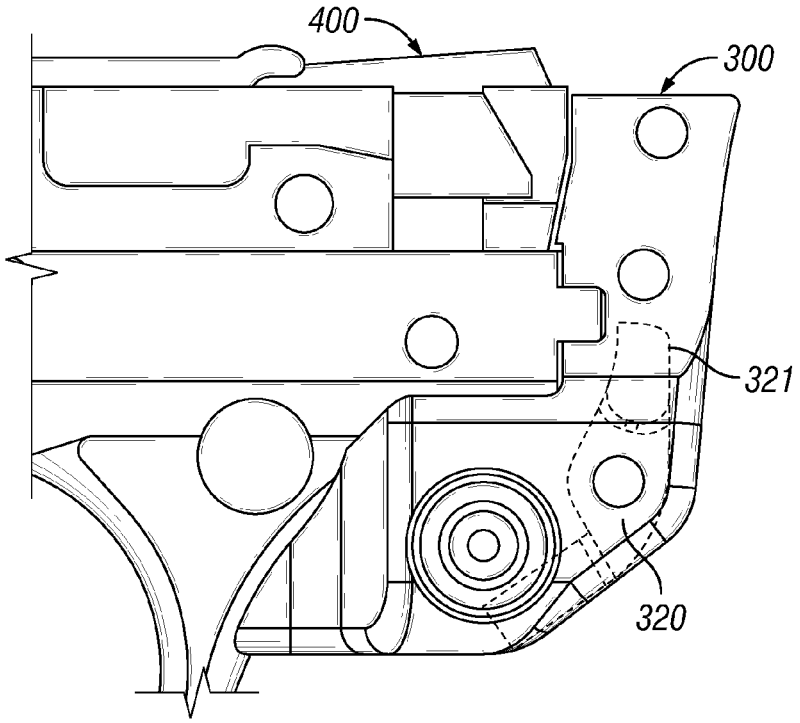
FIG. 22 shows a partial close-up view of the magazine release system retaining a trigger group.
Figure 23:
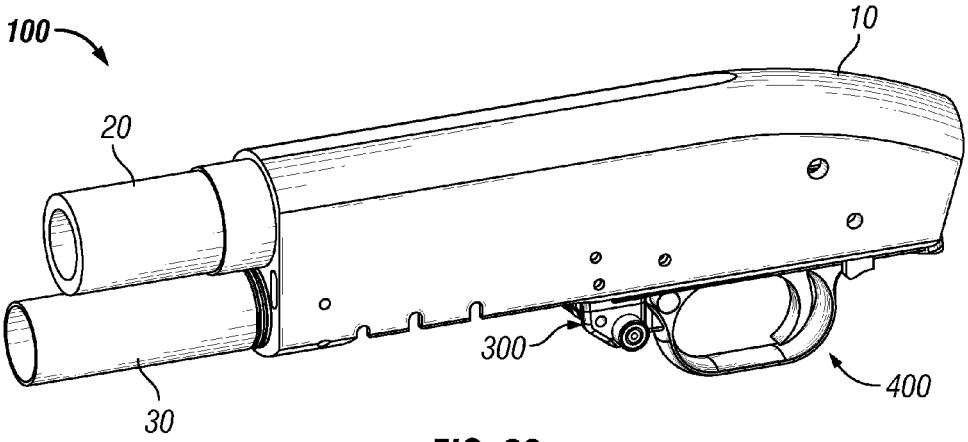
FIG. 23 shows an embodiment of a magazine release system connected to a shotgun receiver.
Figure 24:
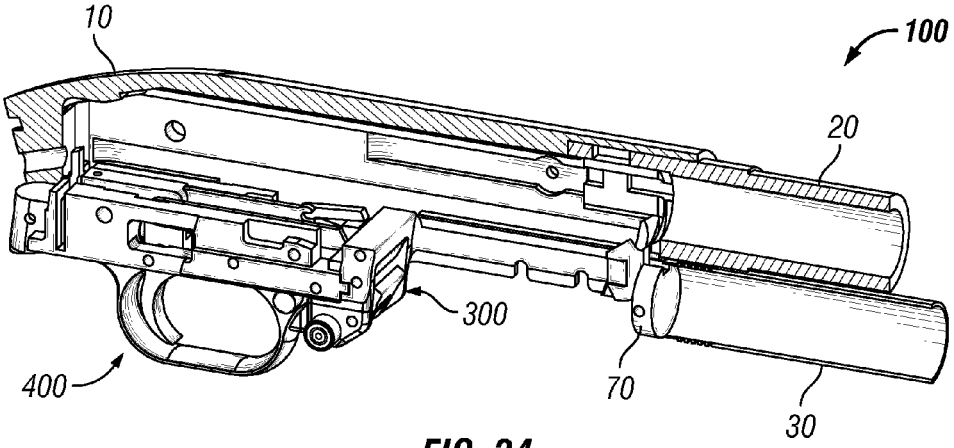
FIG. 24 is a partial cutaway view of a magazine release system and trigger group connected to a shotgun receiver.

FIGS. 21 and 22 show the magazine release system 300 positioned adjacent a trigger group 400. The magazine release system 300 may retain the trigger group 400. A portion of the trigger group 400 is positioned adjacent to the magazine latch 320 and limits the travel of the upper portion 321 of the magazine latch 320 as it pivots due to movement of the magazine button 330 preventing the magazine button 330 from being pushed out of the housing 310 (best shown in FIG. 22). FIGS. 23 and 24 show partial cutaway views of a trigger group 400 and magazine release system 300 installed onto a receiver 10 of a shotgun 100.

Figure 25:
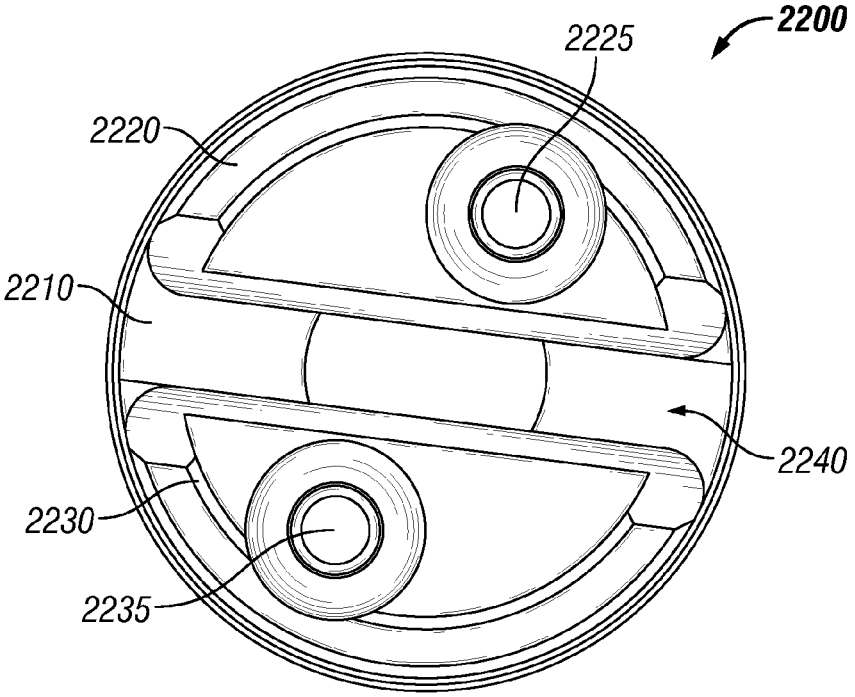
FIG. 25 shows an embodiment of a connector.
Figure 27:
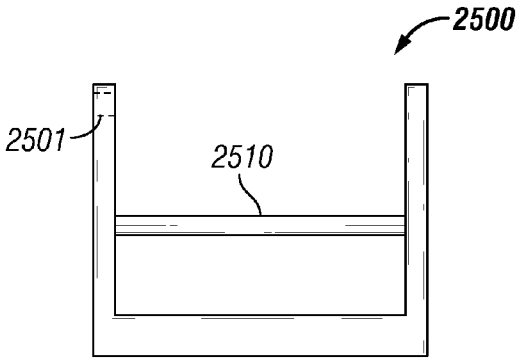
FIG. 27 shows an embodiment of a plug that may be connected to a shotgun receiver.

FIG. 25 shows an embodiment of a connector 2200 that may be used with a plug to selectively connect a magazine tube 30 to a receiver 10 of a shotgun 100. The plug may be various embodiments that include a pin such as the plug 2500 shown in FIG. 27. The plug 2500 may be a cup type plug having one end closed. The plug 2500 may include apertures 2501 that permit the plug to be secured within a portion of a shotgun receiver 10. The plug 2500 includes a pin 2510 that extends across its width that may be accessed via an opening in the end that permits the selective connection of a connector as described herein.

The connector 2200 includes a connector body 2210 that includes threads 2211 on at least a portion of the exterior. The threads 2211 permit the connector body 2210 to be threaded into an end 31 of the magazine tube 30. A first upper portion 2220 and a second upper portion 2230 may be connected to an end of the connector body 2210. The first and second upper portions 2220 and 2230 may be connected to the connector body 2210 via various mechanisms as would be appreciated by one of ordinary skill in the art having the benefit of this disclosure. For example, fasteners may be inserted into apertures 2225 and 2235 to connect the first and second upper portions 2220 and 2230 to the connector body 2210. Alternatively, the first and second upper portions 2220 and 2230 may be formed integral to the connector body 2210 as would be appreciated by one of ordinary skill in the art having the benefit of this disclosure.

Figure 26:
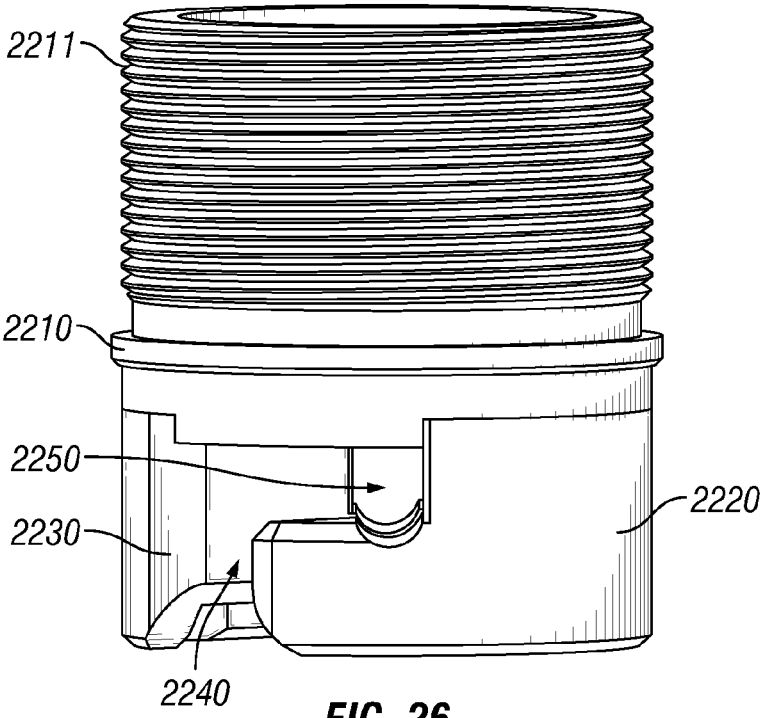
FIG. 26 shows a side view of the connector of FIG. 25.

The first and second upper portions 2220 and 2230 of the connector 2200 are positioned to form a gap between the portions 2220 and 2230. The gap provide a path 2240 through which a pin 2510 on a plug 2500 may travel between the portions 2220 and 2230 to access a locking profile 2250 within the portions 2220 and 2230. FIG. 26 shows a side view of the connector 2200 and illustrates that the locking profile 2250 may be accessed via path 2240 between the portions. The connector 2200 may be inserted into the plug 2500 so that the pin 2510 is aligned with the path 2240. The magazine tube 30, which is connected to connector 2200, may be rotated to position the pin 2510 in the locking profile 2250 after the pin 2510 has traveled the length of the path 2240. The rotation of the magazine tube 30 may be less than one half or even one quarter of a rotation to position the pin 2510 within the locking profile 2250 to selectively connect the magazine tube 30 to the receiver 10.

Figure 28:
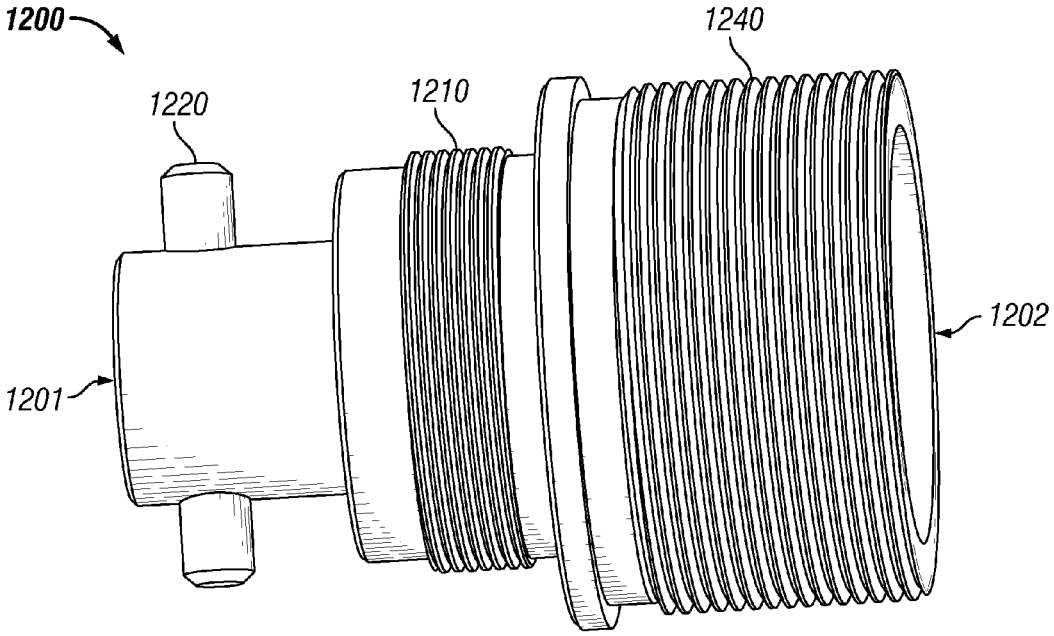
FIG. 28 shows an embodiment of a connector.

FIG. 28 shows an embodiment of a connector 1200 that may be used to selectively connect a magazine tube 30 to a receiver 10. The connector 1200 includes a first end 1201 and a second end 1202. A pin 1220 is positioned through a portion of the connector 1200 near or adjacent to the first end 1201. A first portion 1210 of the connector 1200 includes exterior threads and a second portion 1240 of the connector 1200 also includes exterior threads with the first portion having a smaller diameter than the second portion. The second portion 1240 is configured to be threaded into an end 31 of a magazine tube 30. The first portion 1210 is configured to engage a locking nut 1600 (shown in FIG. 31) that may be used to ensure a tight connected between a magazine tube 30 and a receiver 10 when the connector 1200 is selectively connected to a plug in a receiver 10, such a plug 1500 shown in FIG. 29.

Figure 29:
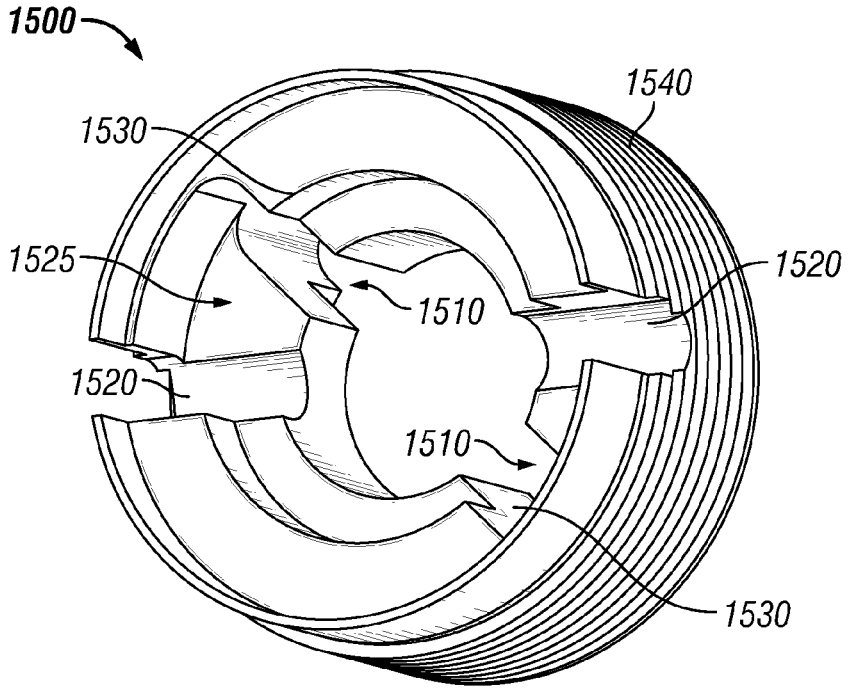
FIG. 29 shows an embodiment of a plug that may be connected to a shotgun receiver.
Figure 30:
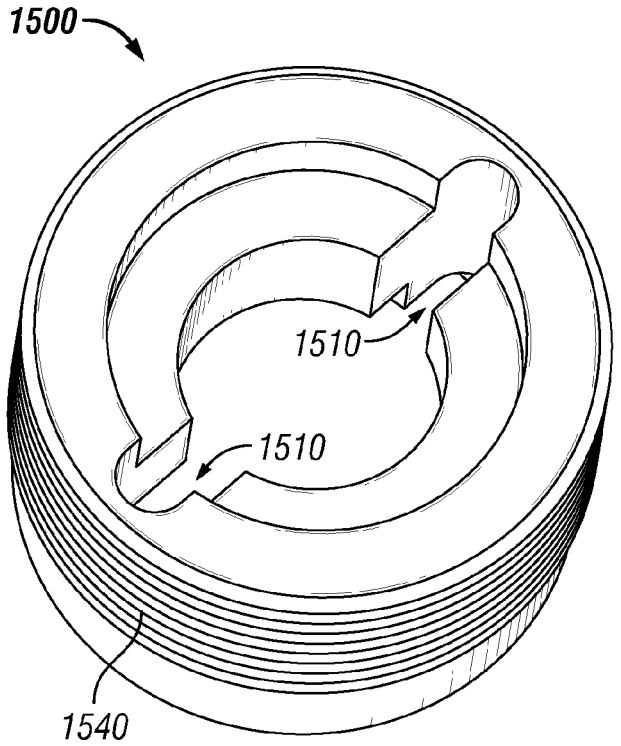
FIG. 30 shows a top perspective view of the plug of FIG. 29.

FIG. 29 and FIG. 30 show perspective views of a plug 1500 that may be used in conjunction with a connector 1200 to selectively connect a magazine tube 30 to a receiver 10. The plug 1500 includes exterior threads 1540 that permits the plug 1500 to be threaded into a portion of a receiver 10. The plug 1500 includes an opening 1510 that permits the insertion of a pin 1220 of a connector 1200 to be inserted into the plug 1500. Once the pin 1220 moves past an internal shoulder 1525 of the plug 1500, the magazine tube 30 and connector 1200 may be rotated to move the pin 1220 into locking profile 1520 of the plug 1500. The positioning of the pin 1220 in the locking profile 1520 selectively connects the magazine tube 30 to the receiver 10. An internal shoulder 1530 adjacent the opening 1510 prevents the pin 1220 from being rotated in the wrong direction or from being rotated past the locking profile 1520.

Figure 31:
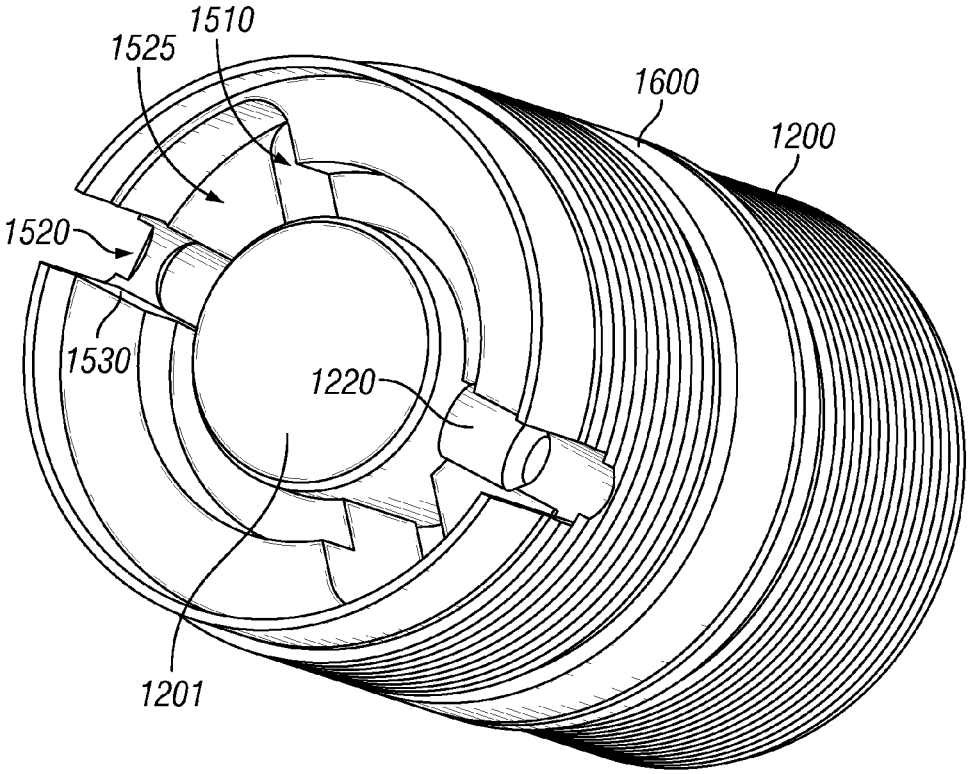
FIG. 31 shows a perspective view of the connector of FIG. 28 connected to the plug of FIG. 29.

FIG. 31 shows a connector 1200 selectively connected to a plug 1500. The plug 1500 is not positioned within a portion of a receiver 10 for illustrative purposes. Likewise, the connector 1200 is not connected to a magazine tube 30 also for illustrative purposes. FIG. 31 shows the pin 1220 of the connector positioned within the locking profile 1520 of the plug 1500. Locking nut 1600 threaded onto the first portion 1210 of the connector 1200 may be rotated to tighten the connected between the connector 1200 and the plug 1500 when assembled with a receiver 10 and magazine tube 30.

Figure 32:
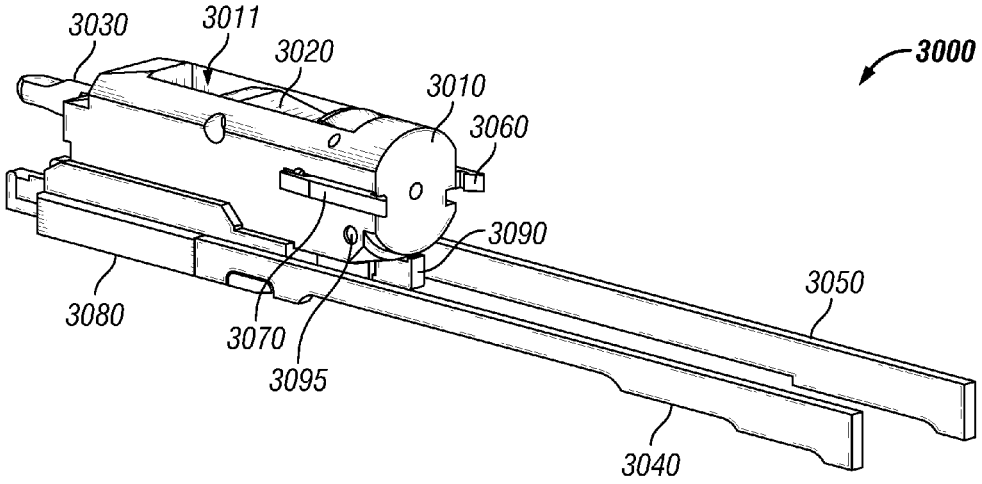
FIG. 32 shows an embodiment of a bolt slide assembly for a shotgun.
Figure 33:
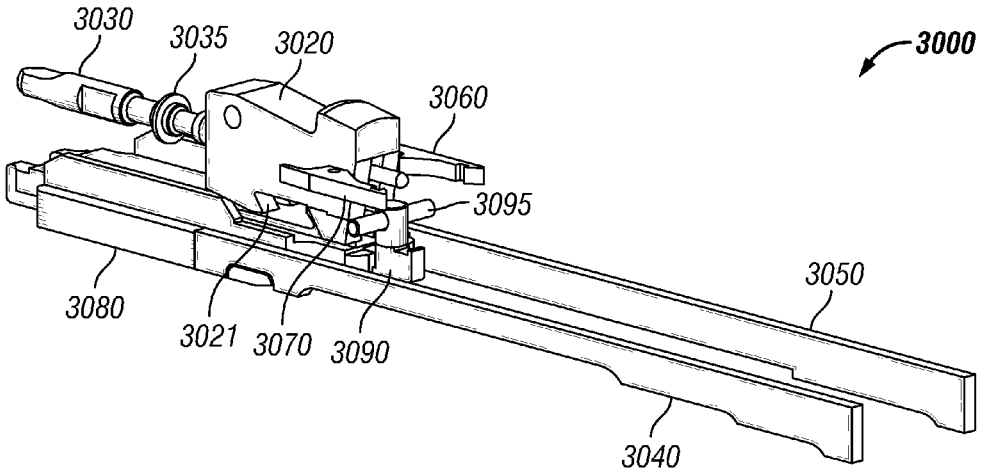
FIG. 33 shows the assembly of 32 with the bolt removed for illustrative purposes.

FIG. 32 shows a bolt slide assembly 3000 with an embodiment of a bolt slide 3080 having a first side wall 3081 and a second side wall 3082. The bolt slide assembly 3000 includes conventional components such as a bolt 3010, bolt lock up arm 3020, firing pin 3030, firing pin washer 3035 (shown in FIG. 33), right rail 3040, left rail 3050, left extractor 3060, right extractor 3070, and bolt sweep 3090. Retaining pin 3095 secures the bolt sweep 3090 to the bolt 3010. The bolt lock up arm 3020 is positioned within an opening 3011 in the bolt 3010. FIG. 33 shows the bolt slide assembly 3000 with the bolt 3010 removed for illustrative purposes. The operation of the bolt slide assembly 3000 is well known in the art and will not be discussed herein.

Figure 34:
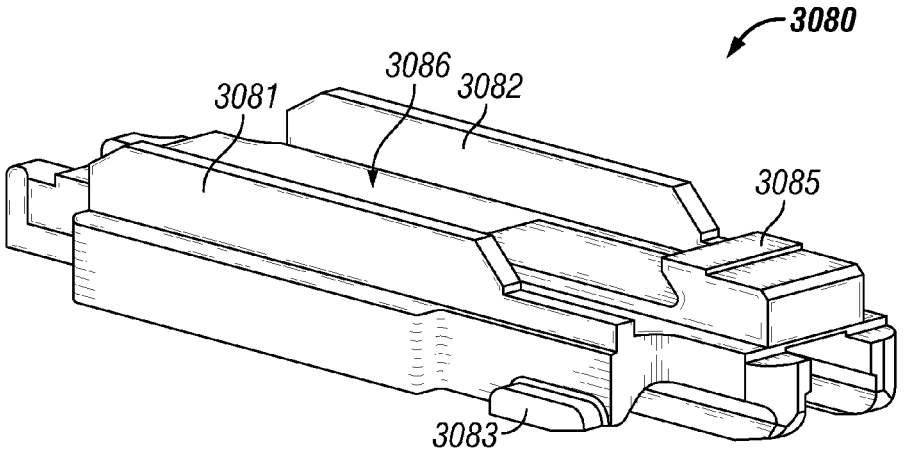
FIG. 34 shows a perspective view of an embodiment of a bolt slide.
Figure 35:
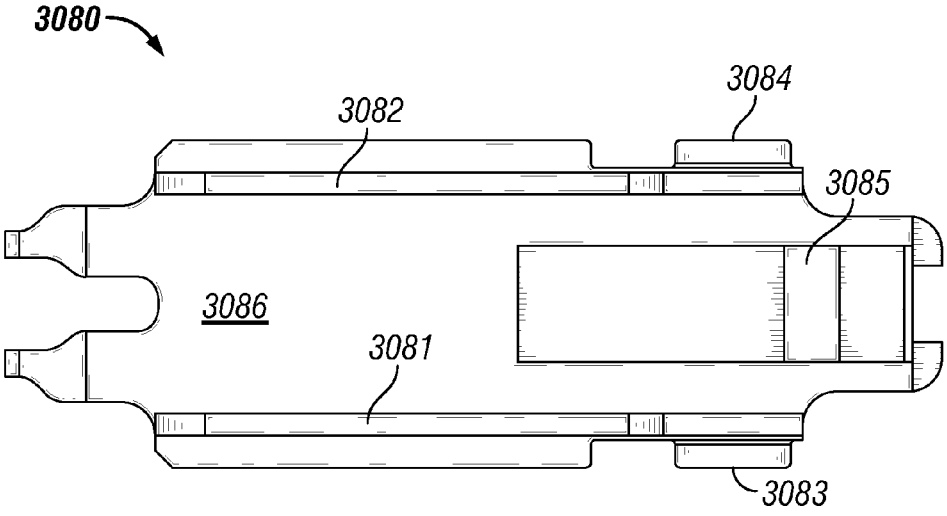
FIG. 35 shows a top view of the bolt slide of FIG. 34.

FIGS. 34 and 35 show an embodiment of a bolt slide 3080 that may be used in the bolt slide assembly 3000. The bolt slide 3080 includes a first side wall 3081 and a second side wall 3082. The bolt 3010 may be positioned in a channel 3086 between the side walls 3081 and 3082. The side walls 3081 and 3082 may help the bolt 3010 to remain centered on the bolt slide 3080 as the action of the firearm cycles. A bolt slide 3080 having side walls 3081 and 3082 may be beneficial when used in a shotgun that has been modified from feeding shells from a magazine tube feeding to feeding shells from a box magazine. The bolt slide 3080 may also include protrusions 3083 and 3084 configured to engage rails 3040 and 3050. The sidewalls 3081 and 3082 guide the movement of the bolt 3010, which may aid in improving the cycling action of the firearm.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A shotgun system comprising:

a receiver having a barrel opening and a magazine tube opening;

a plug having a central opening and a pin positioned across the central opening, wherein the plug is configured to connect to the receiver and wherein at least a portion of the plug is positioned within the magazine tube opening of the receiver;

a magazine tube; and a connector with an access path and locking profile on a first end of the connector, a portion of a second end of the connector being positioned within an end of the magazine tube;

wherein the magazine tube is connected to the plug by inserting the connector into the central opening of the plug to move the pin along the access path and rotating the magazine tube to position the pin in the locking profile of the connector.

2. The shotgun system of claim 1, the connector further comprising:

a spring contained within the connector and configured to bias the pin of the plug within the locking profile of the connector;

wherein the first end has a smaller outer diameter than an outer diameter of the second end.

3. The shotgun system of claim 2, the plug further comprising a first face having a protrusion.

4. The shotgun system of claim 3, wherein the protrusion is biased in an outward position and retracts within the first face when force is applied against the protrusion.

5. The shotgun system of claim 3, wherein the protrusion comprises a ball bearing, and the plug further comprises:

a hollow column containing the ball bearing, the column having a first end at the first face and a second end at a second face, wherein the first end of the column has a smaller diameter than a diameter of the second end of the column, the diameter of the first end being smaller than a diameter of the ball bearing; and a ball detent spring biasing the ball bearing against the first end of the column such that a portion of the ball bearing protrudes beyond the first face.

6. The shotgun system of claim 3 further comprising a nut threaded upon a threaded portion of the first end of the connector, the nut having a detent on a first face configured to engage the protrusion on the first face of the plug.

7. The shotgun system of claim 1 further comprising a ramp connected to the receiver.

8. The shotgun system of claim 7 further comprising a spring positioned between the ramp and the plug, wherein the spring is configured to bias the pin of the plug within the locking profile of the connector.

9. The shotgun system of claim 7, wherein the ramp feeds shells into a firing chamber of the receiver.

10. The shotgun system of claim 7, wherein the ramp includes a recess configured to engage a lug on a magazine inserted into the receiver.

11. A method for rapid assembly and disassembly of a shotgun, the method comprising:

providing a pin within a portion of a shotgun receiver;

providing a locking profile connected to a first end of a magazine tube;

wherein the first end of the magazine tube is configured to be inserted into the portion of the shotgun receiver such that the pin passes into an access path connected to the locking profile; and wherein, the locking profile is configured such that rotation of the magazine tube within the shotgun receiver positions the pin into the locking profile.

12. The method of claim 11, wherein the rotation of the magazine tube is less than one half of a rotation.

13. The method of claim 11, wherein the pin is attached to a plug positioned within the receiver and, wherein the locking profile is on a first end of a connector, a portion of a second end of the connector being positioned within the first end of the magazine tube.

14. The method of claim 13, further comprising:

providing an external thread attached to the first end of the magazine tube; and providing a nut having an internal thread, wherein the nut is configured to thread upon the external thread.

15. The method of claim 14, further comprising:

providing a detent on a face of the nut; and providing a protrusion connected to a portion of the shotgun receiver, wherein the protrusion is configured to engage the detent when the nut is rotated along the external thread.

16. The method of claim 11, further comprising providing a spring configured to bias the magazine tube to selectively retain the pin in the locking profile.

17. The method of claim 16, wherein the locking profile is configured such that pushing against the magazine tube when the pin is in the locking profile overcomes the biasing and rotating the magazine tube positions the pin within the access path.

18. A shotgun system comprising:

a receiver having a barrel opening and a magazine tube opening;

a magazine tube;

a plug with an access path and a locking profile, wherein the plug is configured to connect to the receiver and wherein at least a portion of the plug is positioned within the magazine tube opening of the receiver;

a connector having a pin positioned through a portion of the connector adjacent to a first end of the connector a portion of a second end of the connector being positioned within the magazine tube;

wherein the magazine tube is connected to the receiver by inserting the pin of the connector into the access path of the plug and rotating the magazine tube to position the pin in the locking profile of the plug.

* * * * *